United States Patent [19]

Achelpohl et al.

[11] 4,300,893

[45] Nov. 17, 1981

[54] APPARATUS FOR APPLYING TRANSVERSE WELD SEAMS TO SUPERPOSED WEBS OF PLASTICS FILM, PREFERABLY IN THE PRODUCTION OF BAGS FROM WEBS OF TUBULAR OR SEMI-TUBULAR PLASTICS

[75] Inventors: Fritz Achelpohl; Horst Schneider, both of Lengerich, Fed. Rep. of Germany

[73] Assignee: Windmoller & Holscher, Lengerich, Fed. Rep. of Germany

[21] Appl. No.: 20,173

[22] Filed: Mar. 13, 1979

[30] Foreign Application Priority Data

Mar. 13, 1978 [DE] Fed. Rep. of Germany ..... 2810895

[51] Int. Cl.[3] ..... B31B 23/60

[52] U.S. Cl. ..... 493/194; 156/583.5; 493/204; 493/205; 493/206

[58] Field of Search ..... 93/33 H, 8 R, 93 HT, 93/33 H, DIG. 1; 156/515, 583.5

[56] References Cited

U.S. PATENT DOCUMENTS

| | | | |
|---|---|---|---|
| 2,720,246 | 10/1955 | Piazze | 156/583.5 X |
| 3,075,678 | 1/1963 | Huck | 93/33 R |
| 3,373,664 | 3/1968 | Brockmüller | 93/8 VB |
| 3,390,042 | 6/1968 | Van Der Meulen | 156/583.5 |
| 3,526,169 | 9/1970 | Levenson, Jr. | 93/35 R |
| 3,553,059 | 1/1971 | Stohlquist | 53/553 |
| 4,176,000 | 11/1979 | Achelpohl et al. | 156/583.5 X |

*Primary Examiner*—James F. Coan

*Attorney, Agent, or Firm*—Fleit & Jacobson

[57] ABSTRACT

In bag-making apparatus, superposed plastics film layers of a travelling web are welded transversely along a processing path by pairs of welding jaws carried by chains to form bags which are severed from the web. At the end of or beyond the processing path, holding bars carried by the chains or by further chains parallel thereto engage the bags upstream of the weld seams and transfer them to take-off devices for stacking purposes.

15 Claims, 5 Drawing Figures

APPARATUS FOR APPLYING TRANSVERSE WELD SEAMS TO SUPERPOSED WEBS OF PLASTICS FILM, PREFERABLY IN THE PRODUCTION OF BAGS FROM WEBS OF TUBULAR OR SEMI-TUBULAR PLASTICS

The invention relates to an apparatus for applying transverse weld seams to superposed webs of plastics film, preferably in the production of bags from webs of tubular or semi-tubular plastics, comprising a plurality of oppositely acting welding jaws which are guided in pairs along a planar processing path traversed by the webs, and at both sides of the webs, on endless chains guided over sprockets at the ends of the processing path, enclose the webs between each other, are disposed transversely to the webs and each comprise two parallel welding bars between which there is on one side a cutting knife projecting beyond the bars and on the other side a groove receiving the knife.

An apparatus of this kind described in Applicants' prior patent application Ser. No. 20,066, now U.S. Pat. No. 4,250,796 deals with the production of strong weld seams beyond which no strips of material project to cause a loss of material but it does not deal with how the individual bags severed from the web and provided with weld seams are conveyed out of the apparatus for stacking purposes.

It is therefore the problem of the invention further to develop an apparatus of the aforementioned kind so that the bags produced therein at high speed can be efficiently taken away and stacked.

According to the invention, this problem is solved in that secured to the chains behind the welding jaws as viewed in the conveying direction there are holding bars of which the holding means, when the holding bars move apart in the vicinity of the leading sprockets in the conveying direction, so hold the leading ends of the bags severed from the webs and behind the transverse weld seams that the bags are taken along alternately by the holding bars which move with the upper and lower chains, and that means are provided for taking the bags off the holding bars for stacking purposes. Since the holding bars moving together with the upper and lower sprockets alternately take the bags along with them upwardly and downwardly, the bags supplied at high speed along a production line can be simply distributed amongst two conveying lines in which they need be conveyed at only half the otherwise required conveying speed. If the bags pass through the processing path whilst hanging in loops, so as to keep the path as short as possible, the take-off speed of the finished bags is increased accordingly because they can only be conveyed further in a stretched condition to permit reliable retention and stacking. The apparatus according to the invention permits simple and reliable transfer to the take-off means associated with the transporting means conveying the bags to the stacking stations.

The holding means co-operating with the holding bars may consist of known lateral grippers.

For holding the bags, the holding bars may also be provided with suction nozzles, the leading sprockets being provided at their periphery with suction air connections which come into communication with conduits leading to the suction nozzles.

A compact construction can be achieved if the holding bars are combined with the welding jaws to form a unit.

According to an embodiment of the invention, provision is made that the holding bars equipped with lateral grippers are secured to endless chains which run parallel to the chains carrying the welding jaws and over sprocket disposed at a spacing downstream of the welding jaw sprockets, and that means are provided for taking the bags off the holding bars for stacking purposes. The holding bars running on special chains lead the finished bags out of the processing path after the welding jaws have opened so that the now exposed weld seams that have just been formed can cool off and shrink without stress.

The bags led out of the processing path by holding bars running on special chains can advantageously be stacked in that, for continuous stacking, the lateral grippers of the holding bars alternately open in the sequence of stacking above spaced stacking tables or belts disposed under the lower run of the holding bar chains. In this embodiment, every last stack that has been formed can be taken away whilst the next stack is being formed.

In another embodiment of the invention, it is provided that holding bars which co-operate in pairs and clamp the bags between each other are secured to endless chains which run parallel to the chains carrying the welding jaws and over sprockets at a spacing downstream of the welding jaw sprockets in the conveying direction, that the bags are taken along alternately by the holding bars running with the upper and lower chains, and that means are provided for taking the bags off the holding bars for stacking purposes. This apparatus on the one hand permits unimpeded cooling off of the freshly formed weld seams and on the other hand the discharge of the finished bags from the machine along two conveying lines which move the bags at a slower speed.

The take-off means withdrawing the finished bags from the holding bars running over the sprockets may consist of take-off cylinders which are equipped with suckers or grippers and of which the circumference is larger than the length of the longest bags. The take-off cylinders which rotate at the same peripheral speed as the holding bars contact the arc described by the holding bars along a common tangent so as to ensure safe transfer.

The take-off cylinder may co-operate with a stamping cylinder and means such as suction cylinders which take the stamped out pieces away. In this way the bags can for example be provided with carrying holes or so-called tank-top bags can be provided with cut-outs forming handles.

The take-off cylinders are desirably provided with a folding blade which passes through their wall and pushes the bags into the insert nip of a further conveyor by engaging the transverse fold formed thereby. By means of such transverse folding, the conveying speed can be further reduced, which is desirable for stack formation. The conveyor can drop the transversely folded bags onto stacking means for stacking same. If so-called tank-top bags made from a tubular web provided with side folds are stacked in this manner after transverse folding, they can thereby be withdrawn for use in a simple manner because they are grasped at their cut-out.

To prevent the bags from covering the suction or gripper means and thereby interfering with proper engagement of the next following bag, the circumference of the take-off cylinder is larger than the spacing between two holding bars enclosing a holding bar between each other.

To permit safe transfer even of bags which hang in loops in the processing path, the holding bars desirably have a height resulting in such an acceleration of the bag in the region of the sprocket that bag loops between the tools in the processing path are eliminated.

According to a further embodiment of the invention, it is provided that holding bars which co-operate in pairs and clamp the bags between each other are secured to endless chains which run parallel to the chains carrying the welding jaws and over sprockets which are disposed at a spacing downstream of the welding jaw sprockets in the conveying direction and between which there is the inlet nip of a conveyor engaging the bags at their leading weld seam. This conveyor pulls the finished bags from the holding bars during opening of the latter after the weld seams have cooled off and transfers them to a take-off cylinder.

The conveyor receiving the folded bags can convey these in a suspended condition and transfer them to a conveyor which is provided with grippers and deposits them in a superposed condition on a stacking apparatus. For the purpose of alternate stack formation, it is also possible to provide two stacking apparatuses behind one another at a spacing.

Examples of the invention will now be described in more detail with reference to the drawing, wherein.

Figure 1:
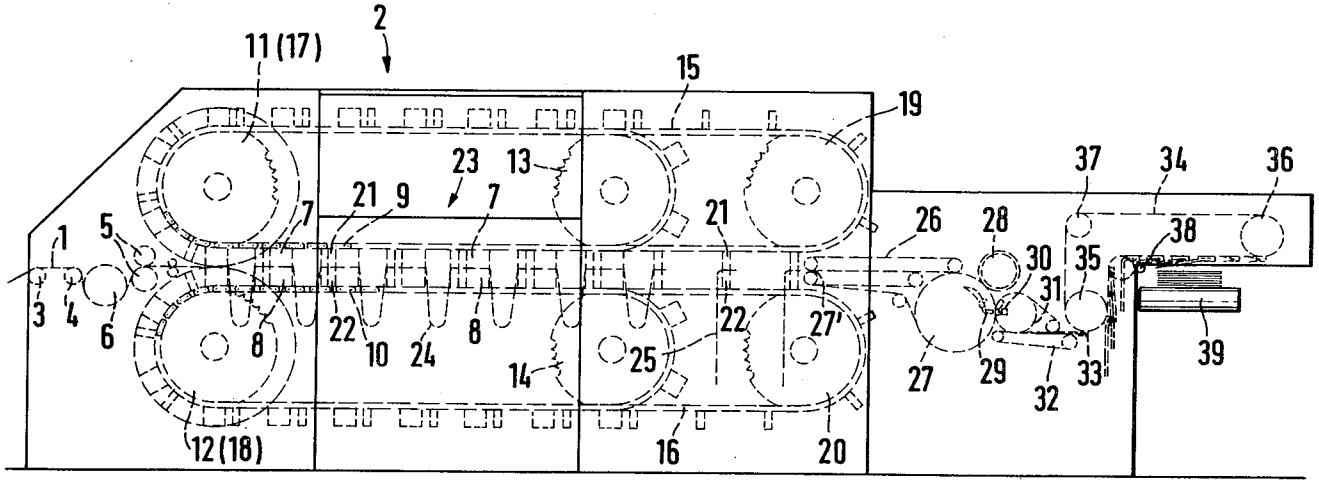
FIG. 1 is a diagrammatic side elevation of the welding apparatus with means for withdrawing and stacking the bags.

In the apparatus shown in FIG. 1, a web 1 is withdrawn in known but unillustrated manner from a supply reel and fed to an apparatus 2 for making bags. Between the supply reel and the apparatus 2, the web 1 can pass through a printing press and be provided with printing. It can consist of a flattened tube, a semi-tube open at one side or of a flattened tube in which the upper layer has been centrally slit. The apparatus can also be fed with two semi-tubes open at one side. The web 1 is fed to a pair of tension rollers 5 by way of the guide rollers 3, 4. In front of the pair of tension rollers 5 there is a guide roller 6 by means of which the lower tension roller is enveloped over a large angle. The web 1 then arrives between a pair of tools 7, 8 which, by means of tool carriers (not shown), is secured to pairs of chains 9, 10 running on both sides of the carriers. The chains 9, 10 pass over sprockets 11 to 14. The pairs of tools 7, 8 are arranged at equal intervals on the chains.

Chains 15, 16 run parallel to the chains 9, 10 over sprockets 17 to 20 and on these holding bars 21, 22 are guided parallel to the tools 7, 8 and at a close spacing therebehind. The leading sprockets 19, 20 of the holding bar chains 15, 16 are disposed at a spacing downstream of the welding jaw sprockets 13, 14 so that the bags made in the processing path 23 are led out of same between the holding bars 21, 22.

The pair of tension rollers 5 runs either faster than or at the same speed as the chains 9, 10 and 15, 16. In the first case the web 1 will form loops 24 between the individual tool and clamping bar pairs 7, 8, 21, 22 as shown in the drawings. In the second case the web 1 runs through the apparatus 2 in a stretched condition.

The pair of tools 7, 8 comprises welding jaws each having welding bars which run parallel to each other and between which there is on one side a cutting knife projecting therebeyond and on the other side a groove receiving same. In the processing path 23, the bags are provided with lateral weld seams or base and head weld seams and are severed from the web by transverse incisions. Between the sprockets 13, 14 the pairs of welding tools 7, 8 open so that the bags 25 which are clamped between the holding bar pairs 21, 22 are transported out of the processing path 23 by the chains 15, 16.

Except for the holding bars 21, 22 running on the chains 15, 16, the apparatus corresponds to the welding machine described in the prior Patent Application Ser. No. 20,066, now U.S. Pat. No. 4,250,796.

Between the sprockets 19, 20 there is a double belt conveyor 26 of which the inlet nip 27' engages the ends of the bags 25 that project beyond the holding bars 21, 22 and are closed by transverse weld seams, namely at an instant at which the holding bars 21, 22 open by running around the sprockets 19, 20.

The double belt conveyor 26 transfers the bags to the take-off cylinder 27 which is equipped with holding means for the bags that may consist of suckers, grippers or holding bands. A stamping cylinder 28 co-operating with the take-off cylinder 27 provides the bags for example with handle holes or, in the case of tank-top bags made from tubular webs with side folds, with cut-outs engaging the inner edges of the side folds. The stamped-out lengths of film are taken away by a suction roller (not shown).

The take-off cylinder 27 is provided with a cam-actuated folding blade 29 which can be projected along a generating line of the take-off cylinder 27 and pushes the bags into the gripping tongs 30 of the backing cylinder 31 by engaging their transverse fold. The backing cylinder 31 at the same time forms an upper direction-changing roller of the double belt conveyor 32 which introduces the bags that have been folded once transversely into the grippers 33 of the gripper chain 34 which is equipped with grippers at equal intervals and runs over sprockets 35, 36, 37.

The bags which have been folded once transversely are initially conveyed in a suspended condition by the gripper chain 34 and, after deflection by a deflecting bar 38, are released over a stacking belt 39 for stacking purposes.

For the alternate formation of stacks permitting one stack to be transported away whilst the other is being formed, two spaced stacking belts may be provided above which the grippers open alternately for the purpose of forming stacks.

The apparatus shown in FIG. 2 differs from that described with reference to FIG. 1 in the manner of withdrawing the bags from the holding bars. At the sides facing the bags 25, the holding bars 21, 22 are provided with suction air nozzles. The sprockets 19, 20 comprise a central suction air passage from which radial suction air conduits 40 branch off. The suction air conduits 40 are, in the vicinity of the surface of the sprockets 19, 20 provided with connecting members 41 which sealingly communicate with the inlets of conduits leading to the suction nozzles and disposed at the backs of the holding bars 21, 22. The suction air conduits 40 leading to the holding bars 21, 22 in the region of the sprockets 19, 20 are so controlled by means (not shown) that the suction air is effective only during opening of the clamping bars and transport of the bags 25 up to the take-off cylinders 42, 42'. The arrangement of the suction air passages as well as the control of the suction air is such that the bags 25 are taken along alternately by the holding bars running along together with the upper sprocket 19 and the lower sprocket 20 and are transferred thereby to the take-off cylinders 42, 42'. The height of the clamping bars 21, 22 above the chains 15, 16 is such that the bags 25 are so accelerated in the vicinity of the sprockets 19, 20 that they can be alternately transferred to the take-off cylinders without overlapping the ends of the newly fed bags.

The take-off cylinders 42, 42' turn at the same peripheral speed as do the take-off bars. At the point of transfer, the arcs described by the holding bars 21, 22 touch the circle described by the take-off element of the take-off cylinders. The take-off element 43 may consist of suction nozzles or also of grippers.

On the take-off cylinders 42, 42', the bags may be provided with cut-outs in the aforementioned manner by the stamping cylinders 28.

The bags are then pushed by the folding blades 29 into the folding tongs 30 of the backing cylinders 31 under their transverse folding and then dropped by the double belt conveyor 32 onto the stacking belts 44, 45 for stacking same.

Figure 3:
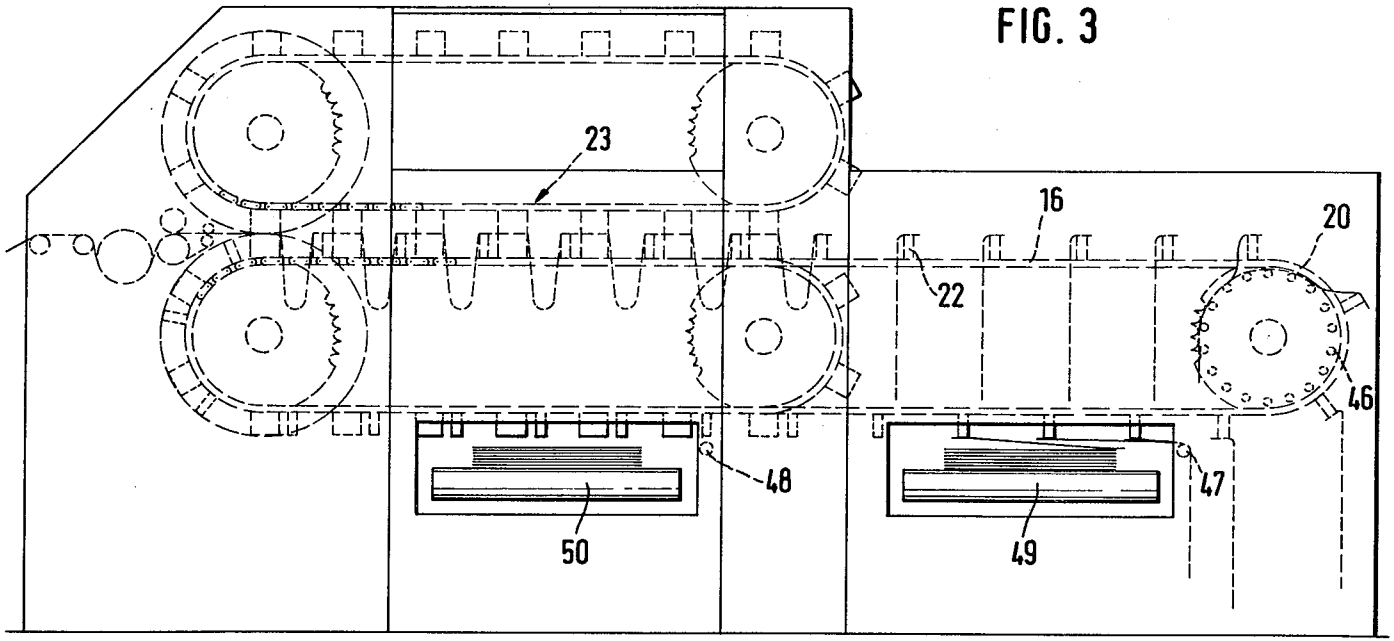
FIG. 3 is a diagrammatic representation of a third embodiment of the welding and stacking apparatus.

In the apparatus shown in FIG. 3, only one lower endless chain 16 is provided which is equipped with holding bars 22 and takes the bags out of the processing path 23. To deflect the bags suspended between the chains 16 about the leading sprocket 20, guide rods 46 are arranged between the sprockets that are disposed at both sides. The bags are conveyed further by the holding bars 22 in the lower run of the chain 16 and, after deflection about the guide rods 47, 48, alternately dropped onto the stacking belts 49, 50 for the purpose of stack formation.

Figure 2:
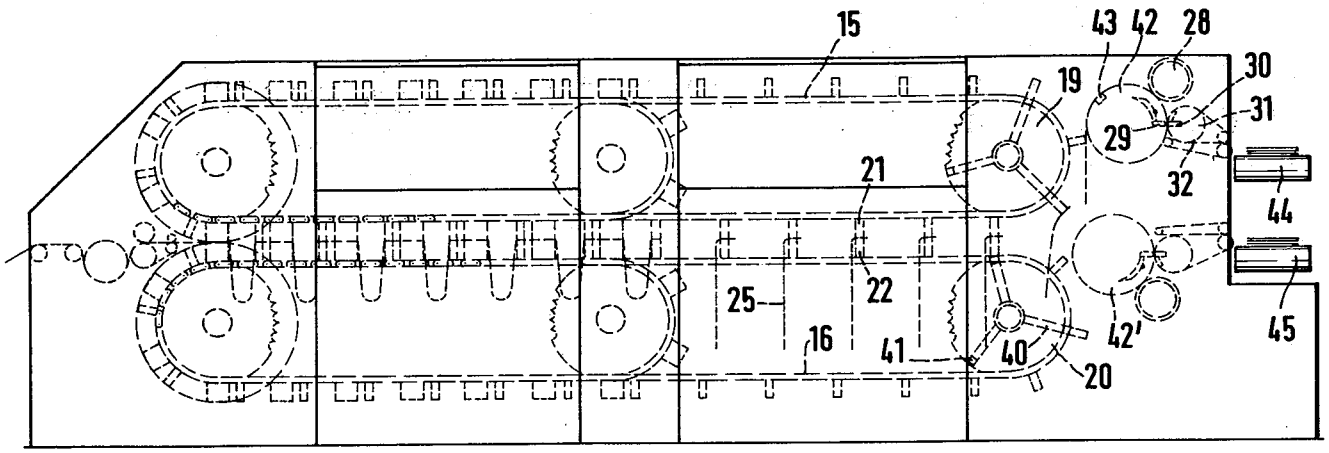
FIG. 2 is a diagrammatic representation of a second embodiment of the welding and stacking apparatus.
Figure 4:
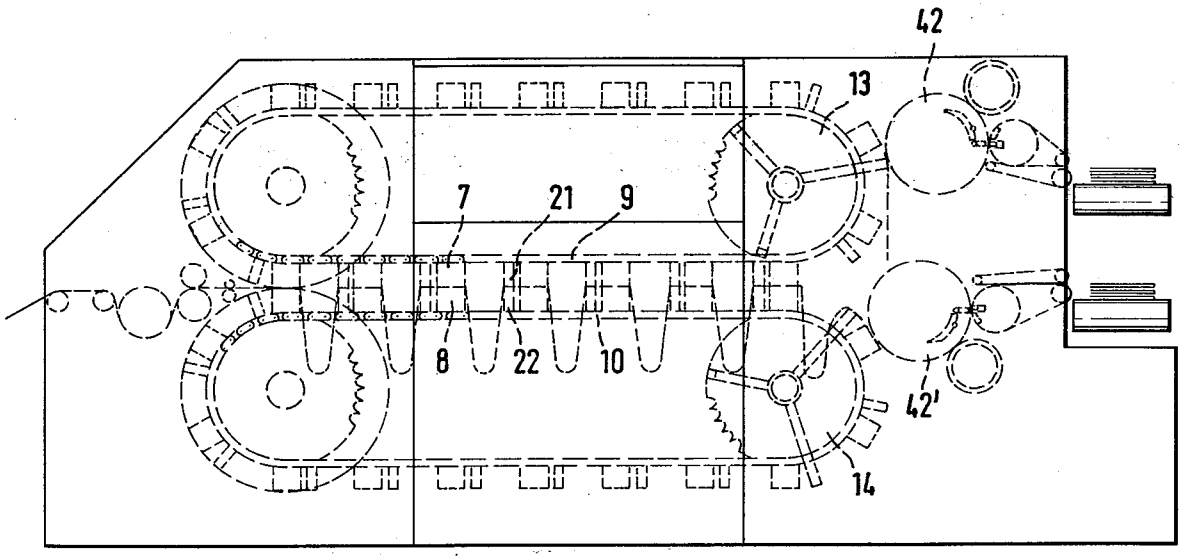
FIG. 4 is a diagrammatic representation of a fourth embodiment of the welding and stacking apparatus without special conveying means for taking the bags out of the processing path.

The apparatus shown in FIG. 4 differs from the FIGS. 1 to 3 embodiments in that, apart from the chains 9, 10 carrying the tools 7, 8, no special chains are provided for the holding bars 21, 22. The holding bars 21, 22 are secured to the chains 9, 10 directly behind the cutting and welding tools 7, 8. The holding bars 21, 22 take the bags along in the region of the leading sprockets 13, 14 in the same way as was described with reference to FIG. 2.

Take-off, further conveying and stacking of the bags likewise takes place in a corresponding manner. Since the holding bars 21, 22 move away from the welding tools 9, 10 when turning over the leading sprockets 13, 14, the weld seams are withdrawn from the welding jaws so that there is unimpeded transfer to the take-off cylinders 42, 42'.

Figure 5:
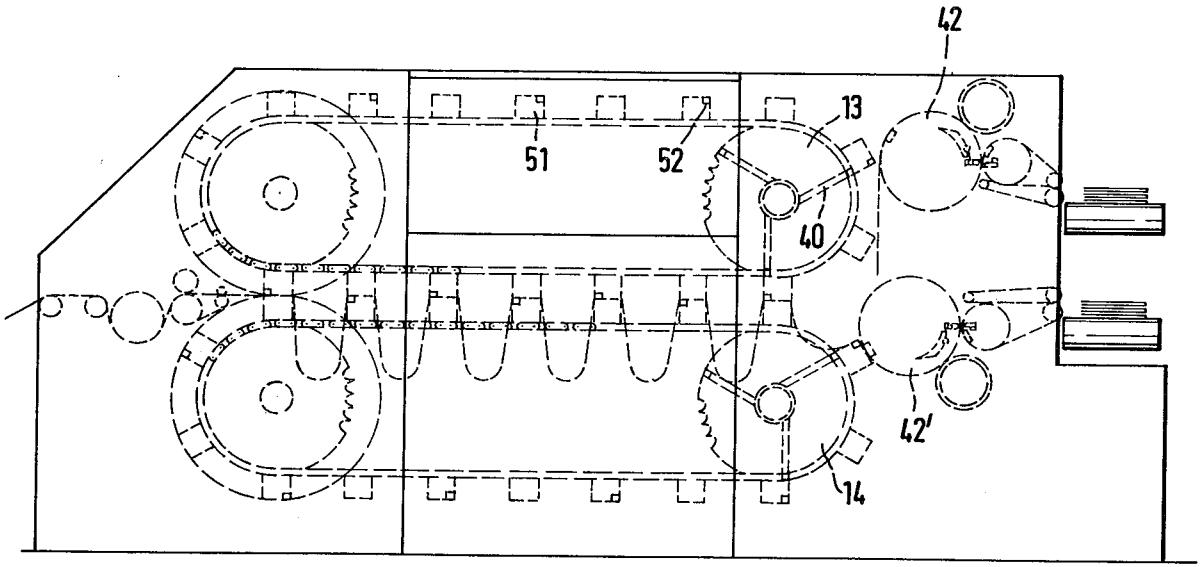
FIG. 5 shows an apparatus according to FIG. 4 in which the welding tools are formed as a unit together with the holding bars.

In the FIG. 5 embodiment, the holding bars are formed as a unit 51 together with the tools so that a more compact and simpler construction is obtained. To enable the bags to be taken along alternately to the top and bottom in the region of the leading sprockets 13, 14, every second tool 51 is provided with a suction nozzle 52 which communicate by way of suitable conduits and connections with the radially extending suction conduits 40 in the aforementioned manner.

To release the weld seams from the welding jaws and obtain a reliable transfer to the take-off cylinders 42, 42', suitable lift-off apparatuses may be provided.

We claim:

1. Apparatus for applying transverse weld seams to superposed webs of plastics film, preferably in the production of bags from webs of tubular or semi-tubular plastics, comprising a plurality of oppositely acting welding jaws which are guided in pairs along a planar processing path traversed by the webs, and at both sides of the webs, on endless chains running over sprockets at the ends of the processing path, enclose the webs between each other, are disposed transversely to the webs and each comprise two parallel welding bars between which there is on one side a cutting knife projecting beyond the bars and on the other side a groove receiving the knife, characterized in that secured to the endless chains (9, 10) behind the welding jaws (7, 8), as viewed in the conveying direction, there are holding bars (21, 22) of which the holding means, when the holding bars (21, 22) move apart in the vicinity of leading sprockets (13, 14) in the conveying direction, so hold leading ends of bags (25) severed from the webs and behind the transverse weld seams that the bags are taken along alternately by the holding bars (21, 22), and that means are provided for taking the bags off (42, 42') the holding bars (21, 22) for stacking purposes.

2. Apparatus according to claim 1, characterised in that the holding means consist of lateral grippers.

3. Apparatus according to claim 1, characterised in that holding bars (21, 22) which co-operate in pairs and clamp the bags between each other are secured to endless chains (15, 16) which run parallel to the chains (9, 10) carrying the welding jaws and over sprockets (19, 20) which are disposed at a spacing downstream of the welding jaw sprockets (13, 14) in the conveying direction and between which there is the inlet nip (27) of a conveyor (26) engaging the bags at their leading weld seam.

4. Apparatus according to one of claims 1 to 2, characterised in that the holding bars (21, 22) and the welding jaws (7, 8) form a unit (51).

5. Apparatus according to claim 1, characterised in that the holding bars (22) equipped with lateral grippers are secured to endless chains (16) which run parallel to the chains (10) carrying the welding jaws (8) and over sprockets (20) disposed at a spacing downstream of the welding jaw sprockets (13, 14).

6. Apparatus according to one of claims 1, 2, 4 or 5, characterised in that, for continuous stacking, the lateral grippers of the holding bars (21, 22) alternately open in the sequence of stacking above spaced stacking tables or belts disposed under the lower run of the welding jaw or holding bar chains.

7. Apparatus according to one of claims 1 or 2, characterised in that holding bars (21, 22) which co-operate in pairs and clamp the bags between each other are secured to endless chains (15, 16) which run parallel to the chains (9, 10) carrying the welding jaws and over sprockets (19, 20) at a spacing downstream of the welding jaw sprockets (13, 14) in the conveying direction, that the bags are taken along alternately by the holding bars (21, 22) running with the upper and lower chains (15, 16).

8. Apparatus according to claim 3, characterised in that the conveyor (26) transfers the bags to a take-off cylinder (27).

9. Apparatus for applying transverse weld seams to superposed webs of plastics film, preferably in the production of bags from webs of tubular or semi-tubular plastics, comprising a plurality of oppositely acting welding jaws, endless chains for guiding the welding jaws in pairs along a planar processing path traversed by the webs, sprockets on both sides of the webs at the ends of the processing path for guiding the endless chains so that the welding jaws enclose the webs between each other, are disposed transversely to the webs and each comprise two parallel welding bars, a cutting knife projecting beyond the bars on one side and, on the other side, a groove for receiving the knife, characterized in that holding bars (21, 22) are secured to the endless chains (9, 10) behind the welding jaws (7, 8), as viewed in the conveying direction, said holding bars (21, 22) having holding means, when the holding bars (21, 22) move apart in the vicinity of leading sprockets (13, 14) in the conveying direction, that so hold leading ends of bags (25) severed from the webs and behind the transverse weld seams that the bags are taken along alternately by the holding bars (21, 22), and that means are provided for taking the bags off (42, 42') the holding bars (21, 22) for stacking purposes, the take-off means comprising take-off cylinders (42, 42') which are equipped with suckers (43) or grippers and of which the circumference is larger than the length of the longest bags (25).

10. Apparatus according to claim 9, characterised in that the take-off cylinders (42, 42') are provided with a folding blade (29) which passes through their wall and pushes the bags into tongs (30) or an insert nip of a further conveyor (31, 32) by engaging the transverse fold formed thereby.

11. Apparatus according to claim 9, characterised in that the conveyor (32) drops the transversely folded bags onto stacking means (44, 45).

12. Apparatus according to claim 9, characterised in that the circumference of the take-off cylinders (42, 42') is larger than the spacing between two holding bars (21, 22) enclosing a holding bar between each other.

13. Apparatus according to claim 9, characterised in that the holding bars (21, 22) have a height resulting in such an acceleration of the bag in the region of the sprockets (13, 14), (19, 20) that the bag loops (24) between the tools in the processing path (23) are eliminated.

14. Apparatus according to claim 9, characterised in that stamping cylinders (28) and means discharging stamped-out pieces co-operate with the take-off cylinders (42, 42').

15. Apparatus for applying transverse weld seams to superposed webs of plastics film, preferably in the production of bags from webs of tubular or semi-tubular plastics, comprising a plurality of oppositely acting welding jaws, endless chains for guiding the welding jaws in pairs along a planar processing path traversed by the webs, sprockets on both sides of the webs at the ends of the processing path for guiding the endless chains so that the welding jaws enclose the webs between each other, are disposed transversely to the webs and each comprise two parallel welding bars, a cutting knife projecting beyond the bars on one side and, on the other side, a groove for receiving the knife, characterized in that holding bars (21, 22) are secured to the endless chains (9, 10) behind the welding jaws (7, 8), as viewed in the conveying direction, said holding bars (21, 22) having holding means, when the holding bars (21, 22) move apart in the vicinity of leading sprockets (13, 14) in the conveying direction, that so hold leading ends of bags (25) severed from the webs and behind the transverse weld seams that the bags are taken along alternately by the holding bars (21, 22), and that means are provided for taking the bags off (42, 42') the holding bars (21, 22) for stacking purposes, the holding bars (21, 22) being provided with suction nozzles for holding the bags (25) and the leading sprockets (13, 14) in the conveying direction being provided at their periphery with suction air connections (41) which communicate with conduits guiding the suction nozzles.

* * * * *